US010172754B2

(12) United States Patent
Chiang et al.

(10) Patent No.: US 10,172,754 B2
(45) Date of Patent: Jan. 8, 2019

(54) MEDICAL AIR MATTRESS

(71) Applicant: Picard Healthcare Technology (Dongguan) Co. Ltd., Dongguan, Guangdong Prov. (CN)

(72) Inventors: Kuang-Neng Chiang, Taipei (TW); Hsui-Lun Liang, Taipei (TW)

(73) Assignee: Picard Healthcare Technology (Dongguan) Co. Ltd., Dongguan (CN)

( * ) Notice: Subject to any disclaimer, the term of this patent is extended or adjusted under 35 U.S.C. 154(b) by 0 days.

(21) Appl. No.: 15/831,587

(22) Filed: Dec. 5, 2017

(65) Prior Publication Data

US 2018/0098901 A1 Apr. 12, 2018

Related U.S. Application Data

(63) Continuation of application No. 13/159,860, filed on Jun. 14, 2011.

(51) Int. Cl.

| | |
|---|---|
| ***A47C 27/10*** | (2006.01) |
| ***A61G 7/057*** | (2006.01) |
| ***A61G 7/02*** | (2006.01) |
| *A61G 7/008* | (2006.01) |
| *A61G 7/05* | (2006.01) |
| *A61G 7/10* | (2006.01) |

(52) U.S. Cl.

CPC ..... *A61G 7/05776* (2013.01); *A61G 7/02* (2013.01); *A61G 7/008* (2013.01); *A61G 7/0525* (2013.01); *A61G 7/1009* (2013.01); *A61G 7/1021* (2013.01); *A61G 2210/90* (2013.01)

(58) Field of Classification Search

CPC ..... A47C 27/10

USPC ..... 5/709–711, 713–715, 655.3

See application file for complete search history.

(56) References Cited

U.S. PATENT DOCUMENTS

| | | | | |
|---|---|---|---|---|
| 2,998,817 A | | 9/1965 | Armstrong | |
| 3,653,083 A | | 4/1972 | Lapidus | |
| 3,678,520 A | | 7/1972 | Evans | |
| 4,193,149 A | | 3/1980 | Welch | |
| 4,617,690 A | | 10/1986 | Grebe | |
| 5,611,096 A | | 3/1997 | Bartlett et al. | |
| 5,647,079 A | * | 7/1997 | Hakamiun | A61G 7/05776 285/124.3 |
| 6,085,372 A | | 7/2000 | James et al. | |

(Continued)

FOREIGN PATENT DOCUMENTS

| | | |
|---|---|---|
| CN | 2198886 | 5/1995 |
| CN | 201019949 | 2/2008 |

(Continued)

OTHER PUBLICATIONS

European Search Authority, Extended European Search Report in related application No. 17205768.9 (dated Mar. 12, 2018).

*Primary Examiner* — Fredrick C Conley

(74) *Attorney, Agent, or Firm* — Fay Sharpe LLP

(57) ABSTRACT

A medical air mattress has a mattress body and an upper bedspread. The mattress body is formed by multiple air cells including independent air cells parallelly arranged as an air cell row. The upper bedspread covers the mattress body. The independent air cells are connected to the independent deflating unit to be deflated independently. When the patient needs to use the bedpan, the independent air cells are deflated to form a recess for receiving the bedpan so that the patient needs not to move.

27 Claims, 13 Drawing Sheets

(56) References Cited

U.S. PATENT DOCUMENTS

| | | | | |
|---|---|---|---|---|
| 6,119,292 | A * | 9/2000 | Haas | A61G 7/001 5/713 |
| 6,370,716 | B1 | 4/2002 | Wilkinson | |
| 2002/0194677 | A1 | 12/2002 | Hayes | |
| 2007/0094805 | A1 | 5/2007 | Davis | |
| 2007/0143928 | A1 | 6/2007 | Biggie et al. | |
| 2008/0178392 | A1 * | 7/2008 | Chu | A61G 7/05776 5/713 |
| 2009/0064118 | A1 | 3/2009 | Genaro et al. | |
| 2010/0325796 | A1 | 12/2010 | Lachenbruch et al. | |
| 2011/0094040 | A1 * | 4/2011 | deGreef | A61G 7/05776 5/713 |
| 2012/0011651 | A1 | 1/2012 | Moss | |
| 2012/0311783 | A1 | 12/2012 | Chiang et al. | |

FOREIGN PATENT DOCUMENTS

| | | | |
|---|---|---|---|
| CN | 201135566 | | 10/2008 |
| CN | 102525768 | | 7/2012 |
| CN | 103340724 | | 10/2013 |
| DE | 69801817 | | 4/2002 |
| GB | 2469540 | | 10/2010 |
| JP | 05228180 | | 9/1993 |
| JP | 06007733 | U | 2/1994 |
| JP | 07116199 | | 5/1995 |
| JP | 2001516241 | | 9/2001 |
| JP | 2002136560 | | 5/2002 |
| JP | 2007159981 | | 6/2007 |
| JP | 3168324 | U | 5/2011 |
| JP | 6050338 | | 12/2016 |
| RU | 2014101149 | | 7/2015 |
| TW | 545240 | | 8/2003 |
| TW | 552931 | | 9/2003 |
| TW | 574918 | | 2/2004 |
| TW | M248432 | | 11/2004 |
| TW | 201231034 | | 8/2012 |
| TW | 201231035 | | 8/2012 |
| WO | 0125835 | | 2/2002 |
| WO | 0238099 | | 5/2002 |

* cited by examiner

MEDICAL AIR MATTRESS

The present invention is a continuation of U.S. patent application Ser. No. 13/159,860 filed Jun. 14, 2011, which is incorporated herein by reference.

BACKGROUND OF THE INVENTION

1. Field of the Invention

The present invention relates to a medical air mattress, especially to a medical air mattress for anti-decubitus purposes.

2. Description of the Prior Arts

For patients who have physical difficulties with mobility or bedfast. Patients lying on a mattress over a long period of time are susceptible to develop decubitus ulcers on multiple areas of the body due to continuous pressure. In order to minimize or eliminate the development of decubitus ulcers caretakers must turn patient's body over or move the patient to alternate the areas of pressure on the body. The conventional medical air mattress was developed to assist in the manual movement of and alternating pressure areas on the patient using multiple odd and even cells alternatively inflated to generate wave motion for changing the contact areas of the patient's body. The conventional medical air mattress has the following inadequacies.

With reference to FIG. 12, because the patients lying on the conventional air mattress have difficulties with mobility or bedfast, patients need to use a bedpan 91 on the conventional air mattress. The conventional air mattress has several detachable air cells 90, which correspond to the position of the patient's hip. When the detachable air cells 90 are removed to form a recess, the bedpan 91 will be able to put into the recess for use. However, to prevent secondary infection and to be cleaned with ease, the conventional air mattress has an upper bedspread to cover on the air cells. Therefore, the upper bedspread needs to be removed before the detachable air cells 90 are removed. Removing the upper bedspread still requires the need to move the patient lying on the conventional air mattress. The design of detachable air cells 90 is inconvenient to caretakers since the patient still needs to leave the conventional air mattress. Furthermore, moving the patient and removing the upper bedspread requires two or more individuals. This is an inefficient use of time and human resources, and the detachable air cells 90 do not function as what the original design expected.

The present invention provides a medical air mattress to mitigate or obviate the aforementioned problems.

SUMMARY OF THE INVENTION

The main objective of the present invention is to provide independent air cells that can be deflated independently to receive the bedpan. The medical air mattress has a mattress body and an upper bedspread. The mattress body is formed by multiple air cells including independent air cells parallelly arranged as an air cell row. The upper bedspread covers the mattress body. The independent air cells are connected to the independent deflating unit to be deflated independently. When the patient needs to use the bedpan, the independent air cells are deflated to form a recess for receiving the bedpan so that the bedspread and the patient have no need to be moved.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
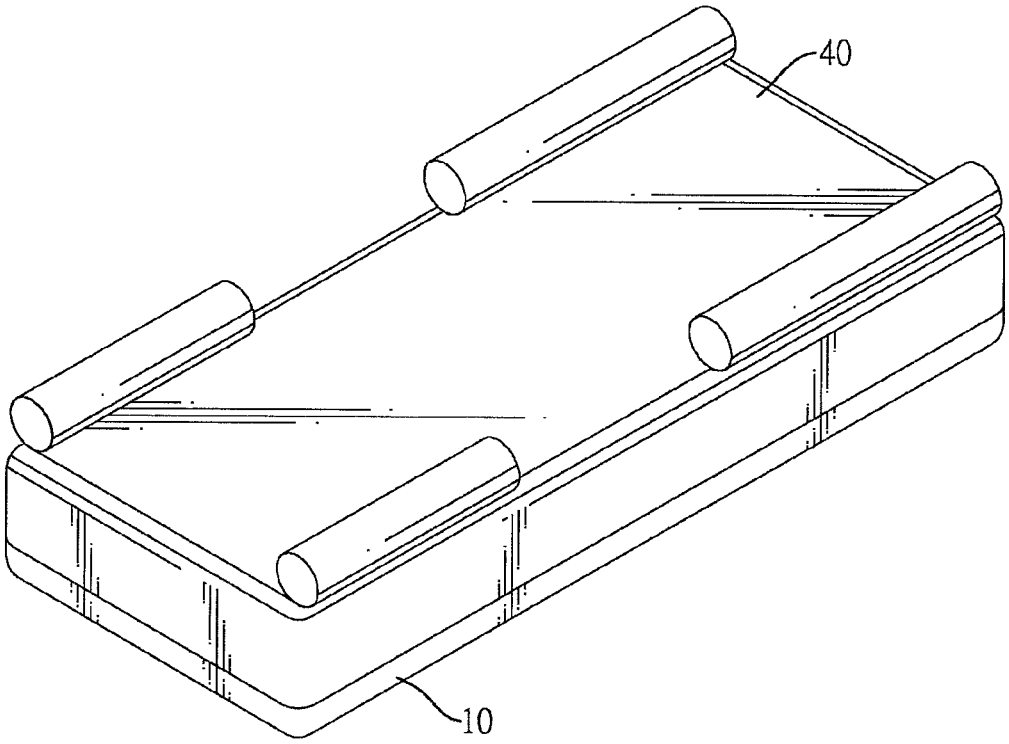
FIG. 1 is a perspective view of a medical air mattress in accordance with the present invention.
Figure 2:
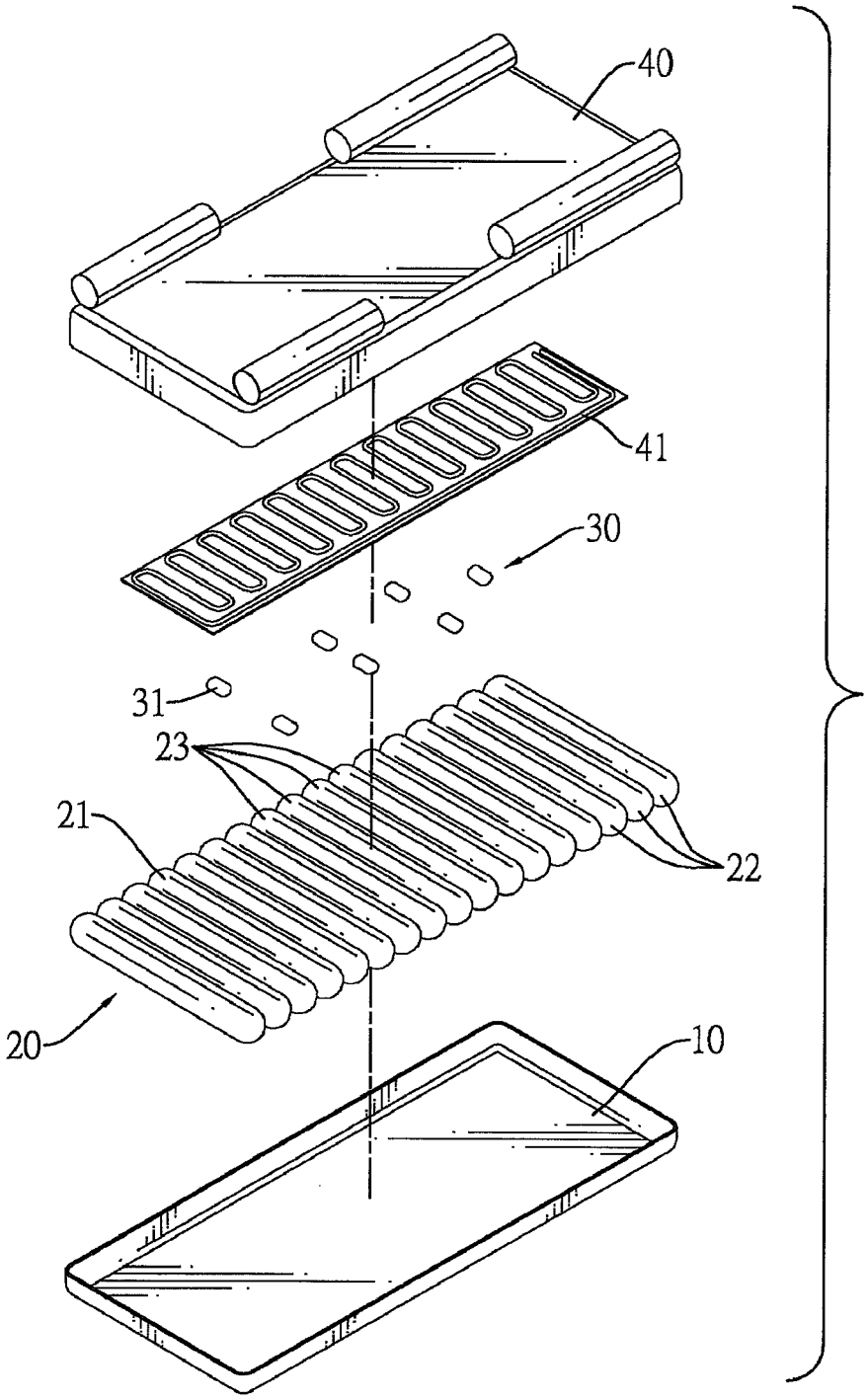
FIG. 2 is an exploded perspective view of the medical air mattress in FIG. 1.

With reference to FIGS. 1 and 2, a first embodiment of a medical air mattress in accordance with the present invention comprises a lower bedspread 10, a mattress body 20 and an upper bedspread 40.

The mattress body 20 is mounted on the lower bedspread 10 and comprises multiple body air cells 21, multiple head air cells 22 and multiple independent air cells 23. In a preferred embodiment, the mattress body 20 comprises three head air cells 22 and four independent air cells 23. Each body air cell 21, each head air cell 22, and the independent air cells 23 are tubular and respectively uniform in diameter. The body air cells 21, the head air cells 22 and the independent air cells 23 are parallel to each other and are arranged in a row to form an air cell row. The head air cells 22 are arranged at a head end in the air cell row, i.e. the head air cells 22 arranged at first to third in the air cell row. The independent air cells 23 are arranged at a central part in the air cell row, i.e. the independent air cells 23 are arranged at seventh to tenth in the air cell row. The body air cells 21 are arranged at fourth to sixth and eleventh to seventeenth in the air cell row.

The upper bedspread 40 covers the mattress body 20 and is connected securely to the lower bedspread 10. A heat unit 41 is attached under the upper bedspread 40 for heating. The heat unit 41 may be carbon fiber electrothermal sheet.

The medical air mattress as described further comprises a massage unit 30 mounted above the mattress body 20. The massage unit 30 comprises multiple micro vibrators 31 to massage the patients lying on the medical air mattress as described. Those micro vibrators 31 distribute massage separately and respectively to patient's neck, back, waist, thighs and so on.

Figure 3:
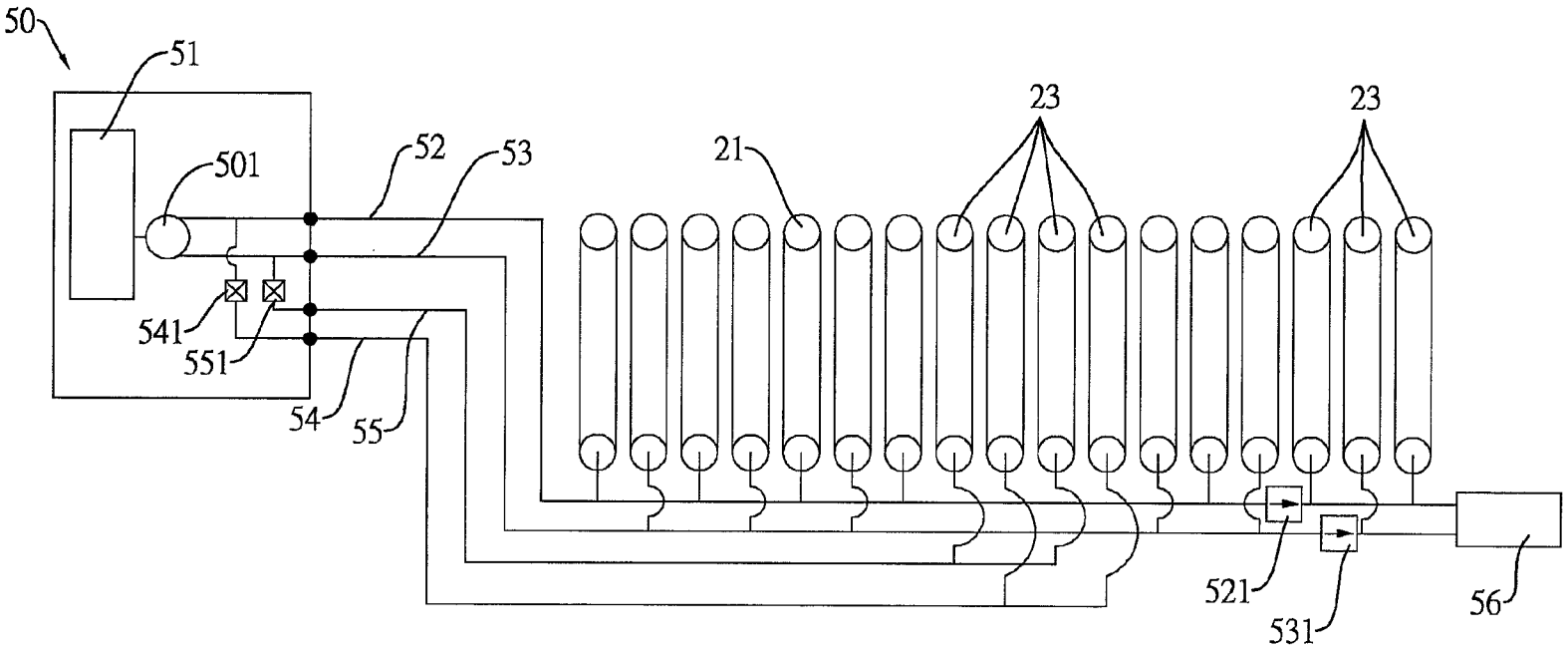
FIG. 3 is a pipeline diagram of the medical air mattress in FIG. 1.

With reference to FIG. 3, the medical air mattress as described comprises a pumping assembly 50. The pumping assembly 50 is connected to and selectively inflates the body air cells 21, the head air cells 22 and the independent air cells 23. In a preferred embodiment, the pumping assembly 50 comprises a pump 51, an odd body pipeline 52, an even body pipeline 53, an odd independent pipeline 54, an even independent pipeline 55 and a rapidly releasing valve 56. The odd body pipeline 52 connects the pump 51 with the odd body air cells 21 and the head air cells 22 at odd rows of the air cell rows. The even body pipeline 53 connects the pump 51 with the even body air cells 21 and the head air cells 22 at even rows of the air cell rows. The odd independent pipeline 54 connects the pump 51 with the independent air cells 23 at odd rows of the air cell rows. The even independent pipeline 55 connects the pump 51 with the independent air cells 23 at even rows of the air cell rows. The rapidly releasing valve 56 is connected to the odd body pipeline 52 and the even body pipeline 53 for rapidly releasing the air in the mattress body 20 for emergency use. For example, when the patient needs C.P.R., the medical air mattress as described needs not be removed or the patient needs not be moved since the mattress body 20 is rapidly deflated to rescue the patient immediately.

In a preferred embodiment, the pump 51 is connected to a body alternating-valve 501. The body alternating-valve 501 is connected between the pump 51 and the body pipelines 52, 53 and the independent pipelines 54, 55 The independent air cells 23 are connected to an independent deflating unit to be deflated independently. The independent deflating unit comprises an odd solenoid valve 541 and an even solenoid valve 551. The odd and even solenoid valves 541, 551 are three-way valves and respectively have deflating opening to the exterior so that the independent air cells 23 are selectively deflated independently via the odd and even solenoid valves 541, 551. The odd independent pipeline 54 is connected to the pump 51 via the odd body pipeline 52. The even independent pipeline 55 is connected to the pump 51 via the even body pipeline 53. In a preferred embodiment, the odd independent pipeline 54 is connected to the odd body pipeline 52 via the odd independent solenoid valve 541, and the even independent pipeline 55 is connected to the even body pipeline 53 via the even independent solenoid valve 551. The odd body pipeline 52 is connected to the head air cells 22 via a first check valve 521. The even body pipeline 53 is connected to the head air cells 22 via a second check valve 531.

Figure 3A:
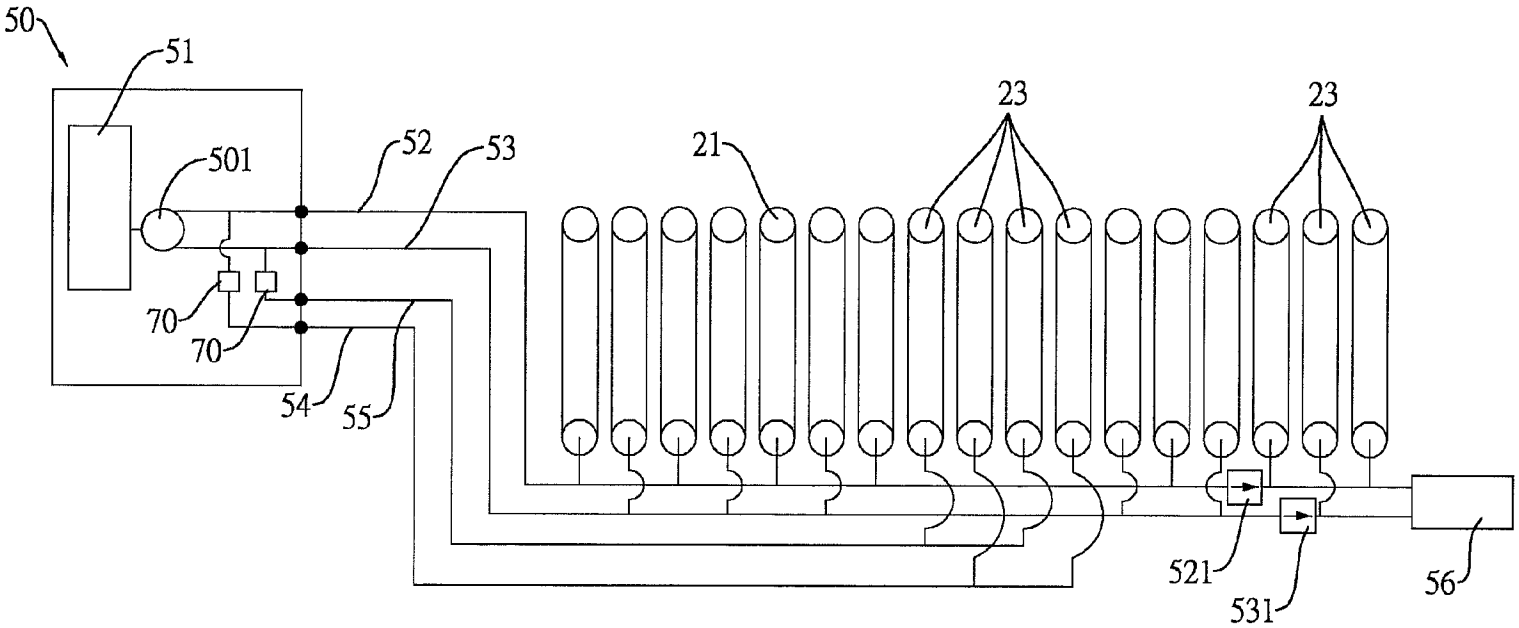
FIG. 3A is a pipeline diagram of the medical air mattress in FIG. 1.

With reference to FIG. 3A, the independent deflating unit for the independent air cells 23 may be a manual alternating device 70. The user controls the manual alternating device 70 to stop inflating the independent air cells 23. The manual alternating device 70 has an air inlet, an inflating opening, a deflating opening, a linking rod, two airflow washers, an air restricting washer and a resilient element. The air inlet is connected to the body alternating-valve 501. The inflating opening is connected to the independent air cells 23 through the independent pipelines 54, 55. The deflating opening communicates with the exterior. When inflating, the deflating opening is closed and the inflating opening is opened to inflate the independent air cells 23. When deflating, the resilient element, the linking rod and the air-resisting washer are manually moved to close the inflating opening and to open the deflating opening. Then the independent air cells 23 are deflated independently.

When the medical air mattress as described is operated, the pump 51, the alternating-valves 501 and the solenoid valves 541, 551 are actuated to inflate the air cells and to alternatively adjust the inflating. The inflating and the deflating operations are described detailedly below.

For the mattress body, when the pump 51 is operated, user may select different modes.

Figure 4:
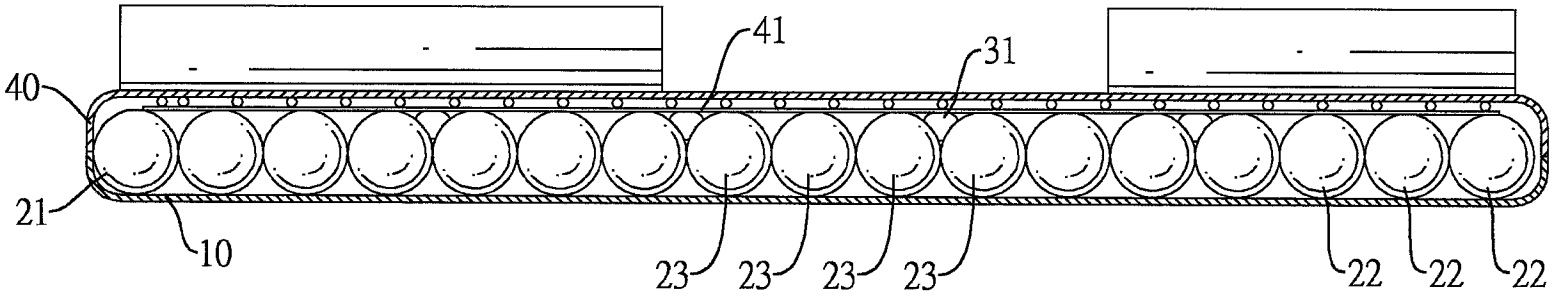
FIG. 4 is an operational side view in partial section of the medical air mattress in FIG. 1, showing the body air cells all inflated.

1. Full inflating mode:

With reference to FIGS. 3 and 4, the pump 51 is operated to inflate the body air cells 21, the head air cells 22 and the independent air cells 23.

Figure 5:
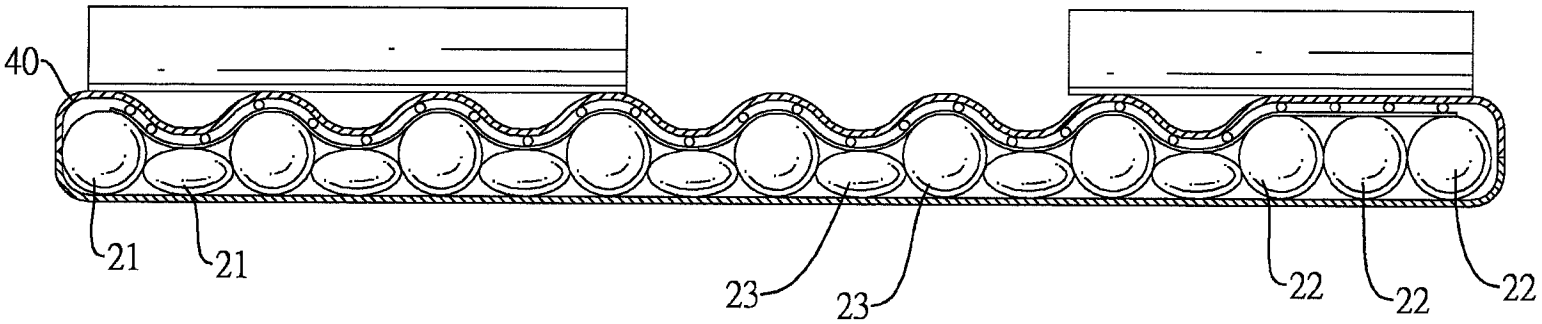
FIG. 5 is an operational side view in partial section of the medical air mattress in FIG. 1, showing the odd body air cells inflated.
Figure 6:
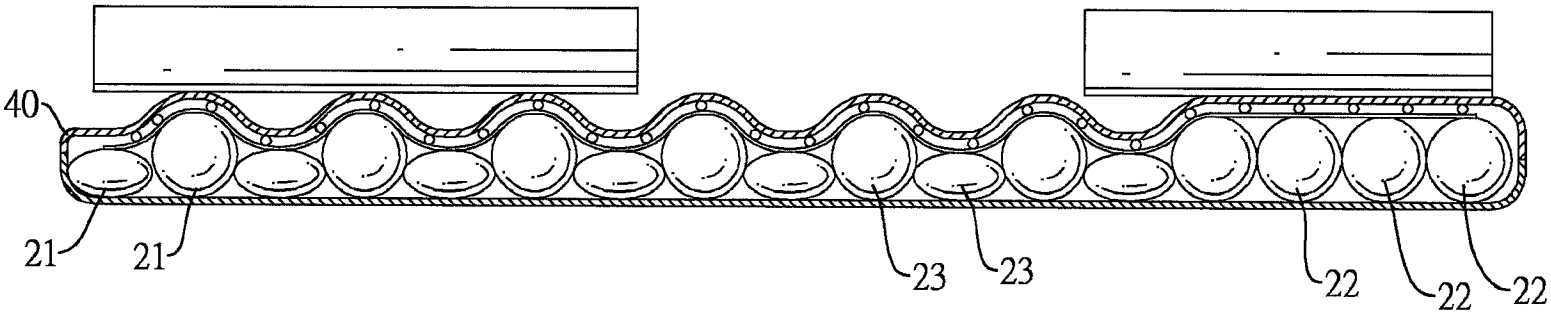
FIG. 6 is an operational side view in partial section of the medical air mattress in FIG. 1, showing the even body air cells inflated.

2. Alternating inflating mode:

With reference to FIGS. 3, 5 and 6, the pump 51 is operated and inflates the body air cells 21 and the independent air cells 23 at odd or even rows of the air cell rows alternatively. In a preferred embodiment, the body alternating-valve 501 accomplishes the alternating inflating. The pump 51 supplies air into the body alternating-valve 501. The body alternating-valve 501 alternatively supplies air into the odd or even body pipelines 52, 53. When the odd body pipeline 52 is inflated, the body air cells 21 and the independent air cells 23 at odd rows of the air cell rows are inflated and the body air cells 21 and the independent air cells 23 at even rows of the air cell rows are deflated as shown in FIG. 5. When the even body pipeline 53 is inflated, the body air cells 21 and the independent air cells 23 at even rows of the air cell rows are inflated and the body air cells 21 and the independent air cells 23 at odd rows of the air cell rows are deflated as shown in FIG. 6. Moreover, since the check valves 521, 531 are connected between the head air cells 22, the odd and even body pipelines 52, 53, the head air cells 22 are kept inflated without deflating by the body alternating-valve 501 to support the patient's head stably.

Figure 7:
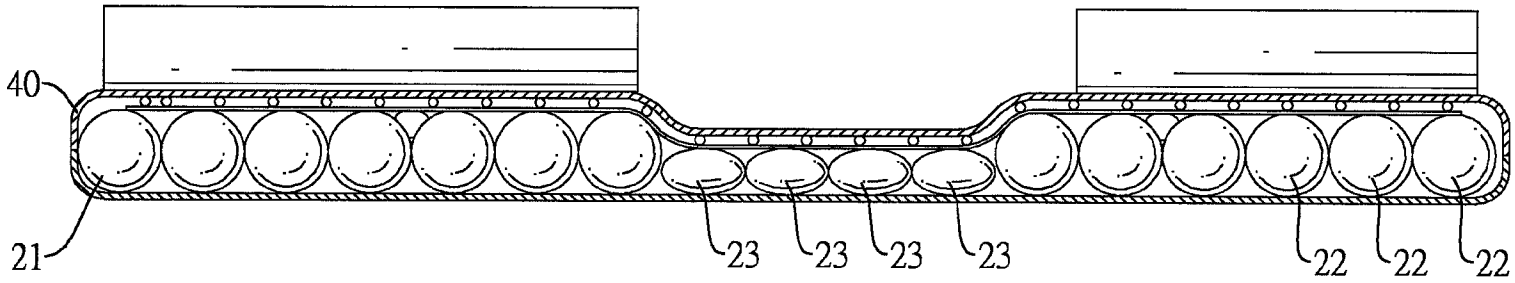
FIG. 7 is an operational end view in partial section of the medical air mattress in FIG. 1, showing the independent air cells deflated.

For the independent air cells 23 as shown in FIGS. 3 and 7, the user may stop inflating the independent air cells 23 independently. In a preferred embodiment, the odd solenoid valve 541 and the even solenoid valve 551 are used to stop inflating the independent air cells 23. Each solenoid valve 541, 551 has an air inlet, an inflating opening and a deflating opening. The air inlet is connected to the body alternating-valve 501. The inflating opening is connected to the independent air cells 23 via through the independent pipelines 54, 55. The deflating opening is connected to the exterior. When the independent air cells 23 are inflated, the deflating opening is closed and the inflating opening is opened. When the independent air cells 23 are deflated independently, the inflating opening is closed and the deflating opening is opened. The central part of the upper bedspread 40 corresponding to the independent air cells 23 is not supported when the independent air cells 23 are deflated. The central part of the upper bedspread 40 is recessed to form a room for receiving the bedpan. Therefore, the patient lying on the medical air mattress as described does not have to move and can use the bedpan while lying on the medical air mattress as described.

Figure 8:
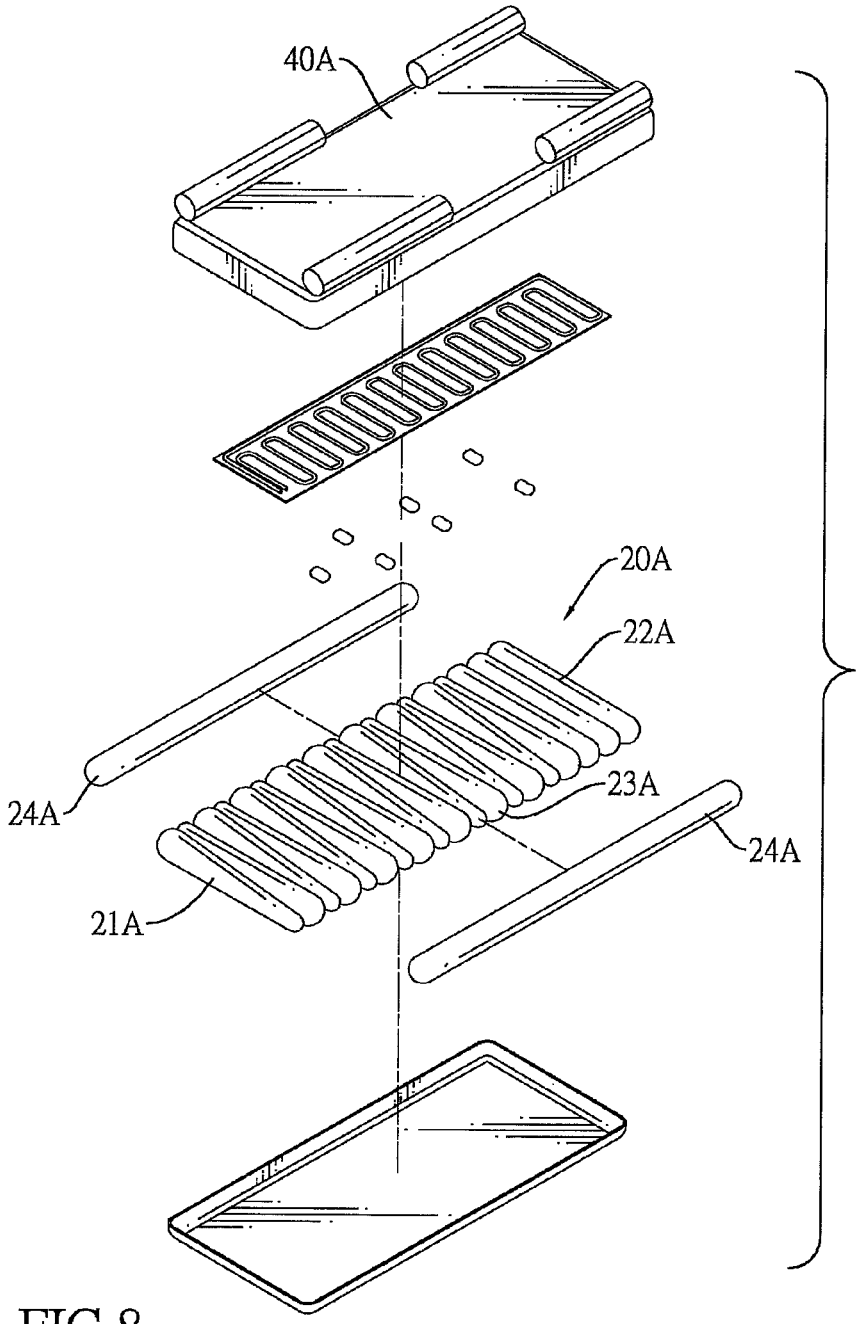
FIG. 8 is an exploded perspective view of another embodiment of a medical air mattress in accordance with the present invention.
Figure 9:
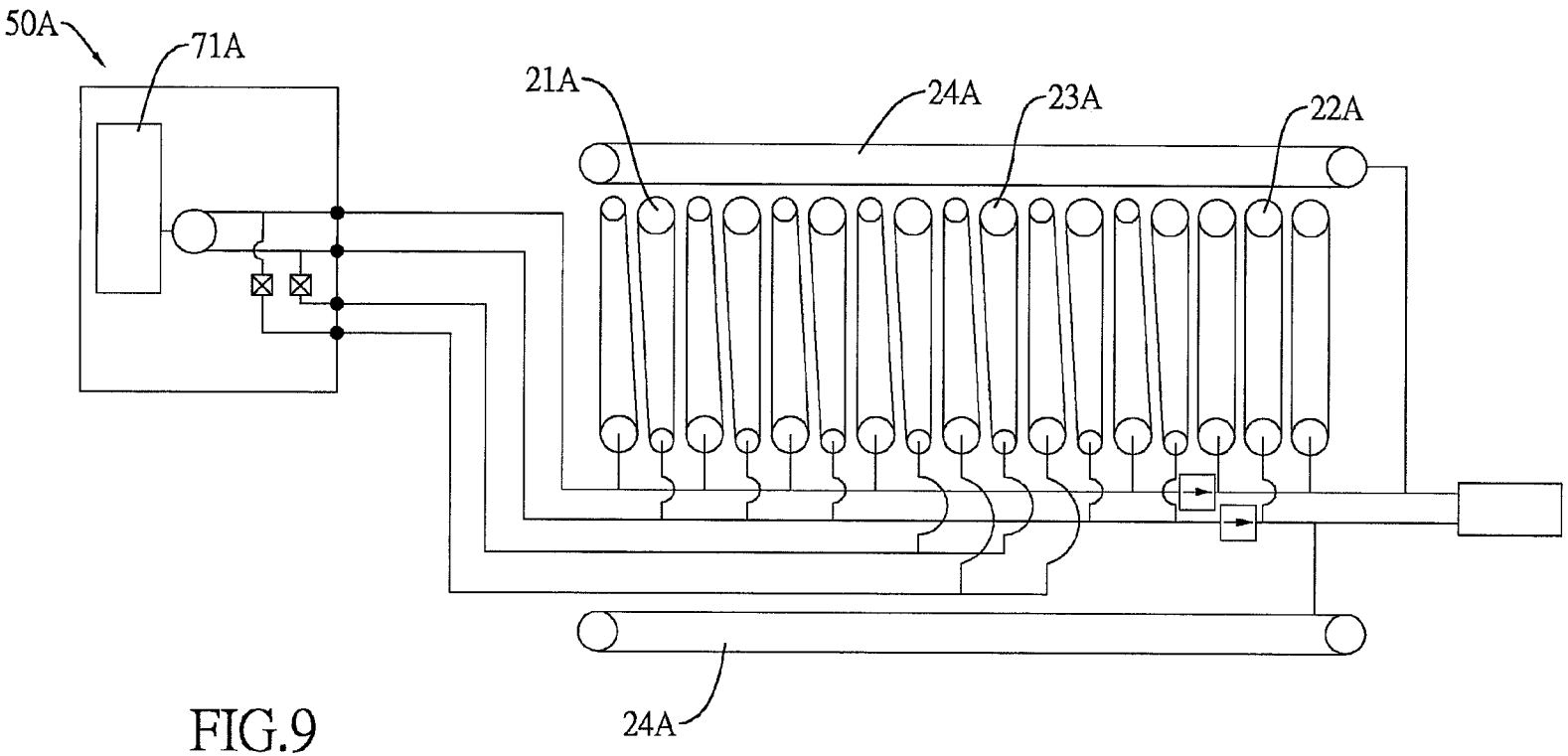
FIG. 9 is a pipeline diagram of the medical air mattress in FIG. 8.

With reference to FIGS. 8 and 9, a second embodiment of a medical air mattress in accordance with the present invention is similar to the first embodiment as described, but the body air cells 21A and the independent air cells 23A of the body mattress 20A are conical. Each body air cell 21A and each independent air cell 23A gradually tapers in diameter from one end to the other end so that each body air cell 21A and each independent air cell 23A has a wide end and a narrow end. The body air cells 21A and the independent air cells 23A are arranged with wide ends adjacent to the narrow ends. For example, the wide ends of the body air cells 21A and the independent air cells 23A at odd rows of the air cell rows align with the narrow ends of the body air cells 21A and the independent air cells 23A at even rows of the air cell rows. The medical air mattress as described further comprises two offset air cells 24A mounted longitudinally and mounted respectively on two sides of the mattress body 20A to enlarge the area of the medical air mattress and to support the upper bedspread 40A. The offset air cells 24A are connected to the pipeline connecting to the head air cells 22A and are also protected by the check valve to maintain inflating.

When the medical air mattress as described is operated, the pump 51A, the alternating-valves and the solenoid valves are also actuated to inflate the air cells and to alternatively adjust the inflating. Since most operations are discussed above, only different operations are described below for the second embodiment of the medical air mattress.

For mattress body 20A, when the pump 51A is operated, user may select different modes.

1. Full inflating mode:

The pump 51A is operated to inflate the body air cells 21A, the head air cells 22A and the independent air cells 23A.

Figure 10:
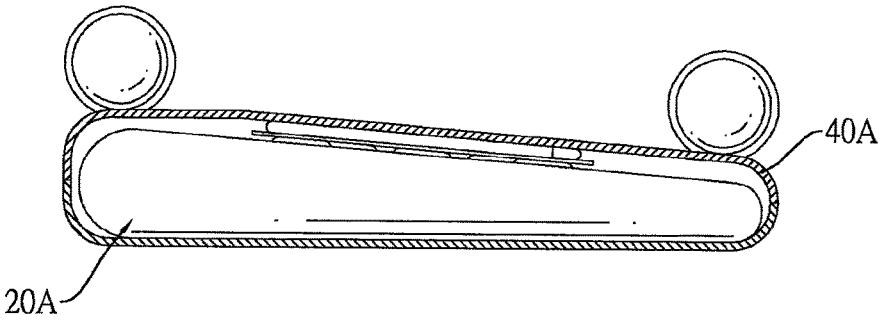
FIG. 10 is an operational end view in partial section of the medical air mattress in FIG. 8, showing the odd body air cells inflated.
Figure 11:
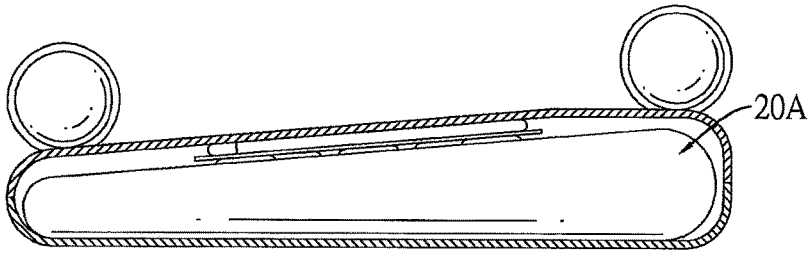
FIG. 11 is an operational end view in partial section of the medical air mattress in FIG. 8, showing the even body air cells inflated.
Figure 12:
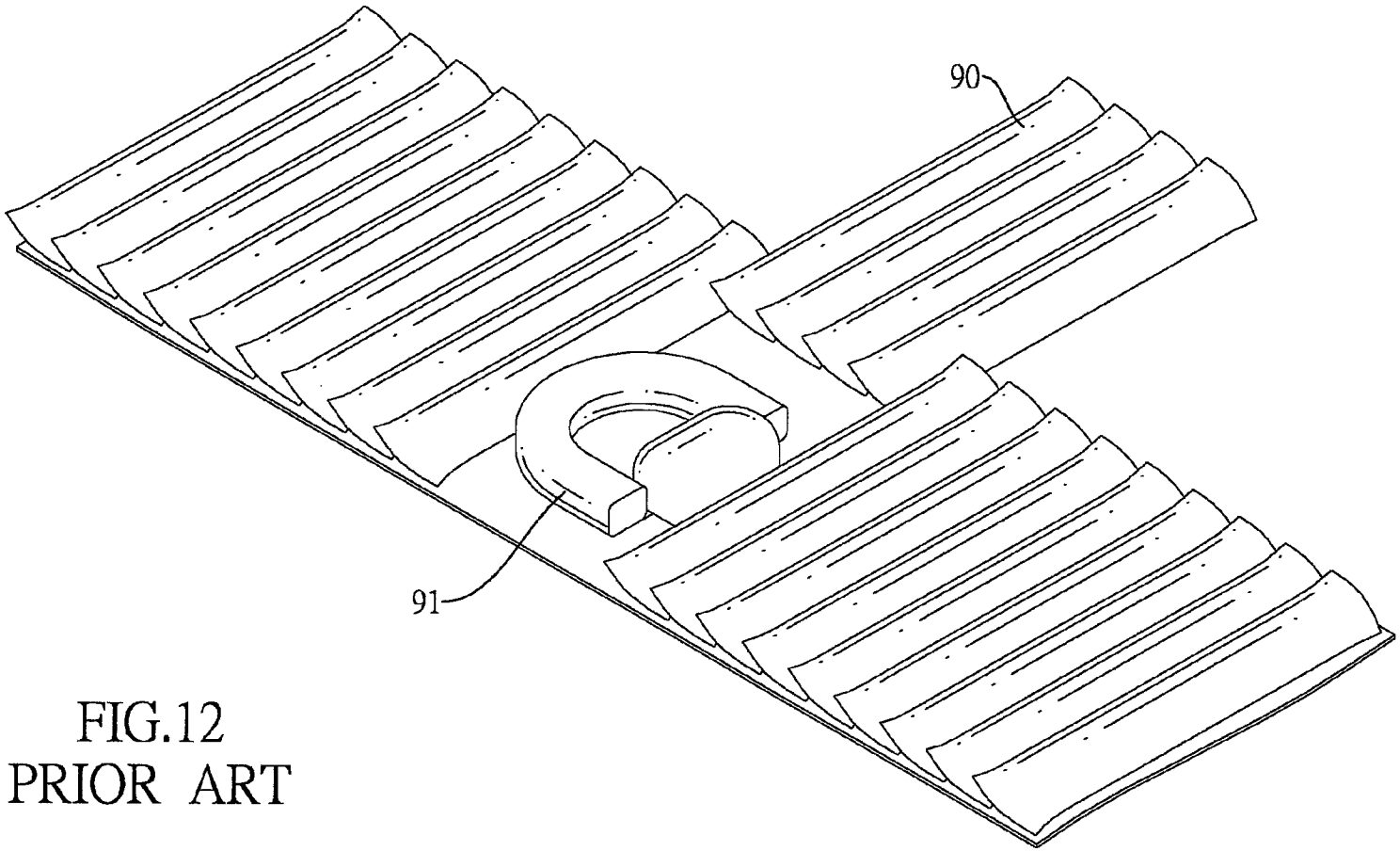
FIG.12 PRIOR ART
FIG. 12 is perspective view of a conventional medical air mattress in accordance with the prior art with a bedpan.

2. Alternating inflating mode:

With reference to FIGS. 9 to 11, the pump 51A is operated and inflates the body air cells 21A and the independent air cells 23A at either odd or even rows of the air cell rows alternatively. When the body air cells 21A and the independent air cells 23A at odd rows of the air cell rows are inflated, the body air cells 21A and the independent air cells 23A at even rows of the air cell rows are deflated as shown in FIG. 10. Since the body air cells 21A and the independent air cells 23A at odd rows of the air cell rows have wide left ends and narrow right ends, the mattress body 20A is higher at left side and lower at right side to tilt the patient rightward. When the body air cells 21A and the independent air cells 23A at even rows of the air cell rows are inflated, the body air cells 21A and the independent air cells 23A at odd rows of the air cell rows are deflated as shown in FIG. 11. Since the body air cells 21A and the independent air cells 23A at even rows of the air cell rows have wide right ends and narrow left ends, the mattress body 20A is higher at right side and lower at left side to tilt the patient leftward. Therefore, the alternating inflating of the body air cells 21A and the independent air cells 23A not only provides the alternating wave of the mattress body 20A, but also tilts the patient at a certain angle. In this embodiment, the body air cells 21A and the independent air cells 23A provides inclined angle at, said 20 degrees.

Even though numerous characteristics and advantages of the present invention have been set forth in the foregoing description, together with details of the structure and features of the invention, the above disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A medical air mattress comprising:

a mattress body comprising multiple body air cells and an odd and an even independent air cell, said multiple body air cells include a plurality of odd body air cells and a plurality of even body air cells, said multiple body air cells are positioned and arranged to each other and arranged in a row to form air cell rows, said multiple body air cells are configured to be inflatable, deflatable, or a combination thereof, each odd body air cell is positioned adjacent to an even body air cell, each odd independent air cell is positioned adjacent to an even independent air cell, said odd and even independent air cells configured to be inflatable, deflatable, or a combination thereof, said odd and even independent air cells are positioned between at least two of said body air cells along a longitudinal axis of said mattress body; and, a pumping assembly connected to said mattress body, said pumping assembly comprising a pump, a body air cell pipeline, an independent air cell pipeline, and an independent deflating unit, said body air cell pipeline connected between said pump and said multiple body air cells and configured to enable fluid to flow between said pump and said multiple body air cells, said independent air cell pipeline connected between said pump and said odd and even independent air cells and configured to enable fluid to flow between said pump and said odd and even independent air cells, said independent deflating unit connected between said pump and said independent air cell pipeline and configured to independently control inflation, deflation, or combinations thereof of said odd and even independent air cells from one or more of said body air cells, and wherein deflation of said odd and even independent air cells within a section of said mattress body creates room to receive a container or bedpan for use by a patient lying on or above said mattress body.

2. The medical air mattress as defined in claim 1, wherein said body air cell pipeline includes an odd body pipeline and an even body pipeline; said independent air cell pipeline includes an odd independent pipeline and an even independent pipeline; said odd body pipeline is positioned between said pump and said plurality of said odd body air cells at odd rows of said air cell rows, said odd body pipeline configured to enable fluid flow between said pump and said plurality of said odd body air cells; said even body pipeline is positioned between said pump and said plurality of said even body air cells at even rows of said air cell rows, said even body pipeline configured to enable fluid flow between said pump and said plurality of said even body air cells; said odd independent pipeline is positioned between said independent deflating unit and odd independent air cell at said odd row of said air cell rows; and said even independent pipeline is positioned between said independent deflating unit and said even independent air cell at said even row of said air cell rows.

3. The medical air mattress as defined in claim 2, wherein said independent deflating unit includes an odd independent valve and an even independent valve, said odd independent valve configured to enable said odd independent air cell at said odd row of said air cell rows to independently inflate, deflate, or combinations thereof, said even independent valve configured to enable said even independent air cell at said even row of said air cell rows to independently inflate, deflate, or combinations thereof.

4. The medical air mattress as defined in claim 3, further including at least one offset air cell positioned beside said mattress body and along a longitudinal axis of said mattress body.

5. The medical air mattress as defined in claim 4, further including a massage unit, a heat unit, or combinations thereof.

6. The medical air mattress as defined in claim 5, wherein said multiple body air cells are uniform in diameter between a width of said mattress body when in an inflated state, said multiple body air cells extend uninterrupted a full width of said mattress body.

7. The medical air mattress as defined in claim 6, wherein said odd and even independent air cells are uniform in diameter when in an inflated state, said odd and even independent air cells extend uninterrupted a full width of said mattress body.

8. The medical air mattress as defined in claim 5, wherein said multiple body air cells are tapered and extend uninterrupted a full width of said mattress body when in an inflated state, each of said multiple body air cells gradually tapers in diameter from a wide end to a narrow end, said multiple body air cells are arranged with wide ends adjacent to narrow ends.

9. The medical air mattress as defined in claim 8, wherein each of said odd and even independent air cells gradually tapers in diameter from a wide end to a narrow end when in an inflated state, said odd and even independent air cells are arranged with wide ends adjacent to narrow ends.

10. The medical air mattress as defined in claim 5, including an upper bedspread and a lower bedspread, said mattress body positioned on or above said lower bedspread, said upper bedspread overlying at least a portion of said mattress body, said upper bedspread at least partially connected to said lower bedspread.

11. A method as defined in claim 3, wherein a patient is less susceptible to bed sores while on said medical air mattress by 1) causing said odd body air cells and said odd independent air cells to simultaneously inflate and causing said even body air cells and said even independent air cells to simultaneously deflate, or 2) causing said even body air cells and said even independent air cells to simultaneously inflate and causing said odd body air cells and said odd independent air cells to simultaneously deflate; and wherein a bedpan is insertable in the medical air mattress by independently deflating both said even and odd independent air cells to create a depression in a central part of said mattress body that is configured to receive the bedpan while maintaining inflation, deflation or combination thereof of either or both said even and odd body air cells.

12. The medical air mattress as defined in claim 1, further including at least one offset air cell positioned beside said mattress body and along a longitudinal axis of said mattress body.

13. The medical air mattress as defined in claim 1, further including a massage unit, a heat unit, or combinations thereof.

14. The medical air mattress as defined in claim 1, wherein said multiple body air cells are uniform in diameter between a width of said mattress body when in an inflated state, said multiple body air cells extend uninterrupted a full width of said mattress body.

15. The medical air mattress as defined in claim 1, wherein said odd and even independent air cells are uniform in diameter when in an inflated state, said odd and even independent air cells extend uninterrupted a full width of said mattress body.

16. The medical air mattress as defined in claim 1, wherein said multiple body air cells are tapered and extend uninterrupted a full width of said mattress body when in an inflated state, each of said multiple body air cells gradually tapers in diameter from a wide end to a narrow end, said multiple body air cells are arranged with wide ends adjacent to narrow ends.

17. The medical air mattress as defined in claim 1, wherein each of said odd and even independent air cells gradually tapers in diameter from a wide end to a narrow end when in an inflated state, said odd and even independent air cells are arranged with wide ends adjacent to narrow ends.

18. The medical air mattress as defined in claim 1, including an upper bedspread and a lower bedspread, said mattress body positioned on or above said lower bedspread, said upper bedspread overlying at least a portion of said mattress body, said upper bedspread at least partially connected to said lower bedspread.

19. A method to inflate/deflate said medical air mattress as defined in claim 1, wherein a patient is less susceptible to bed sores while on said medical air mattress by 1) causing said odd body air cells and said odd independent air cells to simultaneously inflate and causing said even body air cells and said even independent air cells to simultaneously deflate, or 2) causing said even body air cells and said even independent air cells to simultaneously inflate and causing said odd body air cells and said odd independent air cells to simultaneously deflate; and wherein a bedpan is insertable in the medical air mattress by independently deflating both said even and odd independent air cells to create a depression in a central part of said mattress body that is configured to receive the bedpan while maintaining inflation, deflation, or combination thereof of either or both said even and odd body air cells.

20. The method as defined in claim 19, wherein said multiple body air cells and said odd and even independent air cells are gradually tapered in diameter from a wide end to a narrow end, a wide end of said odd or even independent air cell is positioned adjacent to said narrow end of one of said body air cells; and said odd rows of said air cell rows, said even rows of said air cell rows, or combinations thereof are separately inflated, deflated, or combinations thereof.

21. A medical air mattress comprising:

a mattress body comprising multiple body air cells and multiple independent air cells, said multiple body air cells and said multiple independent air cells extend uninterrupted a full width of said mattress body, said multiple body air cells and said multiple independent air cells are positioned and arranged to each other to form air cell rows, said multiple body air cells include a plurality of odd body air cells and a plurality of even body air cells, each odd body air cell is positioned adjacent to an even body air cell, said multiple independent air cells include an odd independent air cell and an even independent air cell, said odd and even independent air cells are positioned adjacent to one another and said independent air cells are positioned between at least two of said body air cells along a longitudinal axis of said mattress body, said multiple body air cells are configured to be inflatable, deflatable, or a combination thereof, said multiple independent air cells are configured to be inflatable, deflatable, or a combination thereof, a pumping assembly connected to said mattress body, said pumping assembly comprising a pump, a body air cell pipeline, an independent air cell pipeline, and an independent deflating unit, said body cell pipeline connected between said pump and said multiple body air cells and configured to enable fluid to flow between said pump and said multiple body air cells, said independent air cell pipeline connected between said pump and said multiple independent air cells and configured to enable fluid to flow between said pump and said multiple independent air cells, said independent deflating unit connected between said pump and said independent air cell pipeline, said independent deflating unit configured to independently control inflation, deflation, or combinations thereof of said multiple independent air cells so that 1) said odd independent air cell can be inflated and deflated simultaneously with said plurality of said odd body air cells, 2) said odd independent air cell can be deflated independently from said plurality of said odd and even body air cells, 3) said even independent air cell can be inflated and deflated simultaneously with said plurality of said even body air cells, 4) said even independent air cell can be deflated independently from said plurality of said odd and even body air cells, and 5) said odd and even independent air cells can be deflated independently from said plurality of said odd and even body air cells, and wherein deflation of said odd and even independent air cells within a section of said mattress body creates room to receive a container or bedpan for use by a patient lying on or above said mattress body.

22. The medical device as defined in claim 21, wherein said pump assembly further includes a body alternating device connected between said pump and said body air cell pipeline and said independent air cell pipeline to provide alternating inflating of said independent air cells.

23. The medical air mattress as defined in claim 21, wherein said independent deflating unit is connected between said independent air cell pipeline and one or more structures selected from the group consisting of a pump, an alternating valve, said odd body pipeline, and said even body pipeline.

24. The medical air mattress as defined in claim 21, wherein said independent deflating unit includes an odd independent valve and an even independent valve, said odd independent valve is configured to enable said odd independent air cell at an odd row of said at least one air cell row to independently inflate, deflate, or combinations thereof, said even independent valve is configured to enable said even independent air cell at an even row of said at least one air cell row to independently inflate, deflate, or combinations thereof.

25. The medical air mattress as defined in claim 24, wherein said multiple body cells and said multiple independent air cells are tapered in diameter from a wide end to a narrow end when inflated, a wide end of each air cell being positioned adjacent to a narrow end of an adjacent air cell; wherein said pumping assembly further includes an alternating valve, said alternating valve connected between said pump and said independent deflating unit, said alternating valve configured to enable said plurality of said odd body air cells and said odd independent air cell to inflate when said plurality of said even body air cells and said even independent air cell are deflated, said alternating valve configured to further enable said plurality of said even body air cells and said even independent air cell to inflate when said plurality of said odd body air cells and said odd independent air cell are deflated.

26. The medical air mattress as defined in claim 21, wherein said multiple body cells and said multiple independent air cells are tapered in diameter from a wide end to a narrow end when inflated, a wide end of each air cell being positioned adjacent to a narrow end of an adjacent air cell; wherein said pumping assembly further includes an alternating valve, said alternating valve connected between said pump and said independent deflating unit, said alternating valve configured to enable said plurality of said odd body air cells and said odd independent air cell to inflate when said plurality of said even body air cells and said even independent air cell are deflated, said alternating valve configured to further enable said plurality of said even body air cells and said even independent air cell to inflate when said plurality of said odd body air cells and said odd independent air cell are deflated.

27. A method as defined in claim 21, wherein a patient is less susceptible to bed sores while on said medical air mattress by 1) causing said odd body air cells and said odd independent air cells to simultaneously inflate and causing said even body air cells and said even independent air cells to simultaneously deflate, or 2) causing said even body air cells and said even independent air cells to simultaneously inflate and causing said odd body air cells and said odd independent air cells to simultaneously deflate; and wherein a bedpan is insertable in the medical air mattress by independently deflating both said even and odd independent air cells to create a depression in a central part of said mattress body that is configured to receive the bedpan while maintaining inflation, deflation or combination thereof of either or both said even and odd body air cells.

* * * * *